US008347893B2

(12) United States Patent
Gold

(10) Patent No.: US 8,347,893 B2
(45) Date of Patent: Jan. 8, 2013

(54) ASSEMBLY FOR THICKENING HAIR

(76) Inventor: David Anthony Gold, Nepi (IT)

( * ) Notice: Subject to any disclaimer, the term of this patent is extended or adjusted under 35 U.S.C. 154(b) by 0 days.

(21) Appl. No.: 12/981,791

(22) Filed: Dec. 30, 2010

(65) Prior Publication Data

US 2011/0094527 A1 Apr. 28, 2011

Related U.S. Application Data

(62) Division of application No. 10/583,584, filed as application No. PCT/IB2004/052866 on Dec. 20, 2004, now abandoned.

(30) Foreign Application Priority Data

Dec. 19, 2003 (IT) ..... RM2003A0585

(51) Int. Cl.
*A41G 5/00* (2006.01)

(52) U.S. Cl. ..... 132/53

(58) Field of Classification Search ..... 132/201, 132/270, 53–56
See application file for complete search history.

(56) References Cited

U.S. PATENT DOCUMENTS

| | | | |
|---|---|---|---|
| 5,861,607 | A | 1/1999 | Jarrett |
| 6,510,856 | B1 | 1/2003 | Ahn |
| 7,036,517 | B2 | 5/2006 | Ott |
| 2002/0185146 | A1 | 12/2002 | Gold |

FOREIGN PATENT DOCUMENTS

| | | |
|---|---|---|
| WO | WO 03/061416 | 7/2003 |

*Primary Examiner* — Rachel Steitz
(74) *Attorney, Agent, or Firm* — Leffert Jay & Polglaze, P.A.

(57) ABSTRACT

An assembly for thickening hair has a first adhesive tape, apt to be reversibly adhered on hair, having an adhesive face onto which there are arranged connecting elements of hair extensions of a first plurality of the hair extensions at their respective distal end, and a second adhesive tape, apt to be reversibly adhered on hair, having an adhesive face onto which there are arranged connecting elements of hair extensions of a second plurality of the hair extensions at their respective distal end, the tapes having positioning elements such that the connecting elements of the extensions of said first and second plurality of the hair extensions overlap when the positioning elements are in turn overlapped.

10 Claims, 8 Drawing Sheets

A-A

ASSEMBLY FOR THICKENING HAIR

RELATED APPLICATIONS

This application is a divisional of U.S. application Ser. No. 10/583,584, titled "METHOD FOR THICKENING HAIR, SEPARATOR DEVICE FOR RECEIVING HAIR, ASSEMBLY FOR THICKENING HAIR AND APPLICATOR FOR THE ASSEMBLY IN THE METHOD FOR THICKENING HAIR," filed May 29, 2007 (abandoned), which is commonly assigned and incorporated herein by reference. U.S. application Ser. No. 10/583,584 claims priority to PCT/IB2004/052866 filed Dec. 20, 2004 which, in turn, claims priority to Italian Patent Application RM2003A000585 filed Dec. 19, 2003.

BACKGROUND OF THE INVENTION

1. Field of the Invention

The present invention relates to a method for thickening hair, or thickening method, and to a related separator device for receiving hair for the application of a thickening assembly, with hair extensions suitable for use in said method. The invention further relates to an assembly of hair extensions for thickening hair and to an applicator for said assembly, suitable for use according to said method.

For thickening hair hereinafter it is meant the lengthening and/or the increasing of volume of human hair, by the application of hair extensions to the receiving hair. For hair extension it is meant a hair extension consisting of a plurality of human or artificial hairs, apt to be handled as single lengthening unit and to be applied on receiving hair by virtue of a connecting element.

2. Description of the Prior Art

Various systems are already known for thickening hair volume and also for lengthening hair. These systems in general use hair extensions or locks, having a natural or artificial origin, which are then fixed to the hair using methods that, based on the proposed application methods, determine the acceptance and satisfaction on the part of the user who has requested such treatment.

Another aspect that helps to increase the satisfaction with this kind of treatment is the speed of implementation.

The known systems include a step wherein the hair extensions are connected to the hair of the user. During this step, the hair extensions can basically be sewn, bonded or knotted to the user's hair but, following these systems, the thickening or the lengthening requires a period of time too long to be carried out, considering that each single hair extension requires a manual and precise operation.

Other methods are known for creating a connection between hair extensions and the hair, requiring the use of external elements such as clasps, combs, grips, etc. These elements can be used to attach hair extensions of large dimensions to the receiving hair of the user, but they have the great inconvenience that the connection is clearly visible and can be felt by the user, who receives an uneasiness feeling from them.

Amongst other known means, there are those that permit size-reduced extensions to be connected to receiving hair. These methods, that require the use of adhesives, small clasping elements, etc., give fairly good results, but in all cases long application sessions are required since the operator must connect each individual hair extension, which cannot be of larger size as otherwise the connection would be visible to the user and to the observers.

Similar difficulties are present with those methods where an adhesive is used, applied to the connection in the method implementation, for example as in the method described in U.S. Pat. No. 4,934,387 (Megna) which is particularly burdensome in terms of time, since the adhesive is dispensed in a liquid and hot state at the end of each hair extension to be fixed. Besides, the operator should manipulate a hot glue with the fingers, with an understandable discomfort. Also U.S. Pat. No. 5,107,867 (Barrington) describes such a kind of method, in which the adhesive is provided on the application site in a predetermined quantity from a gun-shaped dispenser or other applicator. However, in Barrington, the adhesive is confined within a heat shrinkable tubing, allowing setting without its sticking to the other hair.

U.S. Pat. No. 4,982,748 (Trimarchi) proposes the use of a thermocurable adhesive, which accordingly requires a heating after a cold application.

However, these examples of application with adhesives require the complex manipulation of several elements: supplemental hair, adhesive, tubing, gun, entailing also an increase in time.

In addition, the cured adhesive forms a sort of ball or skirt which is distinctly noticeable at the touch, decreasing the easiness degree of the method, and which can also be observed, thwarting the desired aesthetical improvement deriving from the thickening.

Another example of this method, which has gained a hold for the thickening and/or the lengthening extension to extension, is described in JP 03152205 (Aderans Co. Ltd.) and in other subsequent patents referred to improvements of this technique, e.g. the improvement developed by the inventor of the present invention, disclosed in South African Patent ZA 93/5214 or in German Patent DE 196 26 107 C.

These documents describe a thickening element and the related method of application wherein a hair extension is fixed to the hair with the application of a thermoplastic adhesive. In this context, it is clear that the application is manual and that therefore it may not be uniform from extension to extension.

The forcedly manual implementation of these known methods therefore implies a series of drawbacks. First, the operator must have a great experience and practice in this technique, to be able of implementing properly made connections, a condition that obviously is not always possible. In addition, apart from experience, it will be extremely difficult to produce uniform connections: they will vary greatly as they will not be positioned exactly along the lines proposed for the hair thickening, and they will vary in quality and size.

All this means that the quality of the finished work will not be optimal, will be more exposed to wear, with imperfections that cannot be rectified, increased costs due to very long application times and the difficulty in locating experienced operators.

In addition, again the cured adhesive forms a sort of ball or skirt which is distinctly noticeable at the touch, decreasing the easiness degree of the method, and which can also be observed, thwarting the desired aesthetical improvement deriving from the thickening.

A further improvement was described in International application WO 02/098250 in the name of the present Applicant and designating the same inventor of the present invention.

In this document, a method and an assembly of hair extensions is disclosed for increasing hair volume, by means of the application of a set of extensions in one step, exploiting an adhesive tape to arrange the connecting elements in the right position and then activating them simultaneously.

This system, though allowing to greatly speed up the application of hair extensions, does not solve the problem of the imperfect connections resulting of unsatisfactory dimensions and that can also be seen.

Similar remarks may be made on the basis of International application WO 2004/023910 in the name of the present Applicant and designating the same inventor of the present invention.

To this drawback is also related the problem of determining the exact quantity of receiving hair for each adhesive-based connecting element. It is understood that the behaviour of the connecting element will be different according to said quantity, and therefore it is possible that, in the same application, from adjacent connecting elements different effective connections result.

SUMMARY OF THE INVENTION

The technical problem underlying the present invention is to provide a method for thickening hair, a separator device, a thickening assembly with hair extensions and an applicator suitable for use in said method, which allow to obviate to the drawbacks mentioned in connection with the state of the art and in general to improve the simultaneous application of hair extensions.

The solution idea consists of providing a method and an assembly for thickening hair with no manual operation required and allowing the application of hair extensions in sets, carrying out a perfect integration between the connecting elements supporting the hair extensions and the user's receiving hair.

In particular, it is desired to provide an application method such as to include the use of devices making the application itself easy and immediate.

Such a problem is solved by a method as above specified, comprising the steps of: providing a first plurality of hair extensions having respective proximal ends provided with a respective connecting element; providing a first adhesive tape with a first adhesive face and arranging, according to a predetermined arrangement, said proximal ends onto the first adhesive face; arranging a separator device at a portion of hair to be thickened, so that said portion may be separated in adjacent portions, containing basically the same quantity of receiving hair, each portion being corresponding to a connecting element placed on said adhesive tape and equidistant from the other portions; keeping tensioned said portion of hair to be thickened; providing a second adhesive tape to be overlapped on said first tape and enclosing, between said first and second adhesive tape, said portion of hair to be thickened, arranging said connecting elements at the respective portion of receiving hair; removing said separator device from said portion of hair; and activating connection means operating on said connecting elements of the hair extensions.

According to the same inventive concept, said technical problem is solved by a separator device for receiving hair, for the application of a thickening assembly, which comprises: a plurality of hair extensions having respective proximal ends provided with a respective connecting element; an adhesive tape with an adhesive face onto which there are arranged said proximal ends according to a predetermined arrangement, the separator device being characterized in that it comprises: first separation tooth elements, equidistant and such as to subdivide a portion of hair into portions containing basically the same quantity of receiving hair; a bearing surface for arranging said adhesive tape in position, delimited on one side by said first tooth elements; and second tooth elements, arranged on the opposite side with respect to said first tooth elements, having with respect to the latter a greater density and interspaces such as to arrest the receiving hair inserted therebetween.

The main advantage of the method and of the separator device according to the present invention lies in allowing a fast application of a high number of hair extensions in one step, simultaneously carrying out a corresponding number of connections with very small dimensions, as carried out with the correct number of receiving hair.

In the definition of the method according to the invention, for first and second adhesive tape it is meant two distinct portions of adhesive tape, belonging to the same section of adhesive tape, with said portions being identified by folding of the tape itself, as well as consisting of two distinct tape sections.

According to a preferred embodiment of the present invention, the assembly that is employed in the method according to the invention comprises a first plurality of hair extensions, with respective connecting elements arranged on the adhesive face of the first adhesive tape, and a second plurality of hair extensions, with respective connecting elements on the adhesive face of said second adhesive tape.

The position of the connecting elements on the first adhesive tape and of the connecting elements on the second adhesive tape is complementary, so that the receiving hair remain entrapped between overlapped connecting elements of said first and second tape. In the assembly for thickening hair, there is provided means for positioning said tapes so that the respective connecting elements overlap to adhere to single portions of receiving hair.

According to a further preferred version of the invention, said first and second adhesive tape are two distinct sections of adhesive tape.

In light of the concentration of the receiving hair in hair portions to which said connecting elements will be fixed, there arises the need to concentrate the action of the connection means just on said portion of receiving hair and on respective connecting element or elements, with an effective positioning for said concentrated action.

Hence, the invention also relates to a hair extension applicator, of the kind employed for thickening hair via the application, to the natural hair, of hair extensions, comprising: a fixed contrasting element bearing connecting elements of hair extensions on a tape and corresponding portions of receiving hair of hair to be thickened, separated and corresponding to a respective connecting element; and a movable pressure element acting on said fixed element, said movable pressure element being driven by a pneumatic device operating at a predetermined pressure, apt to press on connecting elements of hair extensions on an adhesive tape and corresponding portions of receiving hair of hair to be thickened enclosed by tapes, characterized in that it comprises means for positioning the tapes, the connecting elements and the hair portions, in a predetermined position on said fixed and pressure elements.

In a preferred embodiment of the above applicator, it comprises respective recesses of said fixed and pressure elements in a position such as to house respective connecting elements when they are pressed by the pressure element.

BRIEF DESCRIPTION OF THE DRAWINGS

The present invention will hereinafter be disclosed according to several embodiments thereof, given by way of non-limiting examples and with reference to the annexed drawings.

DETAILED DESCRIPTION OF THE PREFERRED EMBODIMENTS OF THE INVENTION

Figure 2:
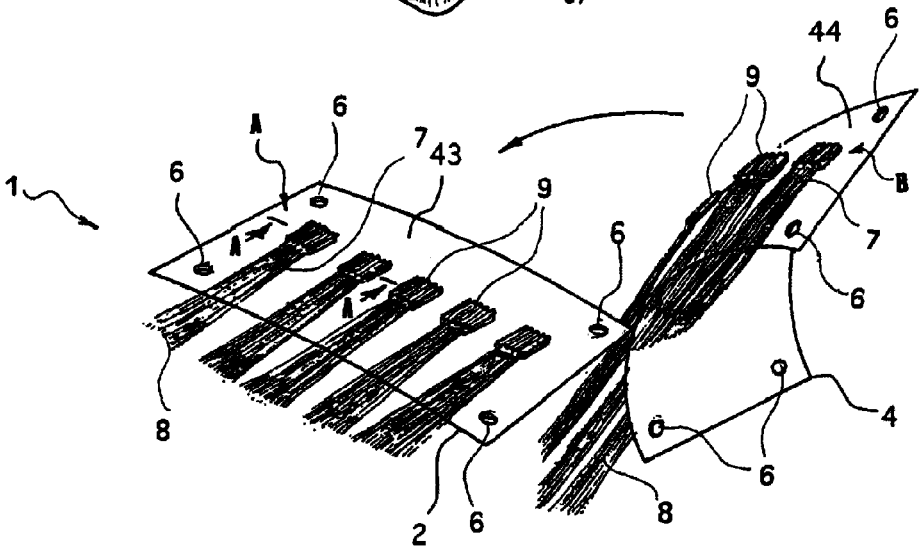
FIG. 2 shows a perspective view of a thickening assembly to be employed in the method according to the invention.
Figure 3:
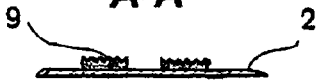
FIG. 3 illustrates a section of a detail of the assembly of FIG. 2.

With reference to FIGS. 2 and 3, it is disclosed a thickening assembly, generally indicated by 1, which in general comprises hair extensions.

It comprises a first adhesive tape 2 which is, preferably but not exclusively, substantially transparent, being intended to be applied to the hair to be thickened in the thickening method.

Therefore, the transparency allows to follow more clearly the application steps and the effect attained even with the tape 2 applied.

The material forming the first adhesive tape 2 is suitably, but not exclusively, heat resistant for the reason that will be detailed below. The adhesive used is a non-permanent, pressure operated and reversible type, and it is placed on a single adhesive face 43 of the tape 2.

The assembly 1 further comprises a second adhesive tape 4, with peculiarities preferably in all analogous to those disclosed with reference to the first adhesive tape 2, having a respective second adhesive face 44.

Always with reference to FIG. 2, it is disclosed a first plurality A of hair extensions C, comprising a quantity of substantially predefined hairs which can be natural or artificial, with appropriately selected colors, uniform or streaked.

The assembly 1 according to the invention can comprise hair extensions C of different thickness, length and color. In general, they extend from respective proximal ends 7, intended to be connected to the hair, to free distal ends 8. In each hair extension C, the respective hairs have a length that is preferably uniform.

At said proximal ends 7, each hair extension C comprises a connecting element 9 produced, according to the present embodiment, from a thermoplastic material such as polyamide, polyester or even a polyurethane, for example nylon.

Each proximal end 7 and each connecting element 9 is placed on said first adhesive face 43 of the first adhesive tape 2. The connecting elements 9 are substantially equidistant and placed at the center of the tape 2. The hair extensions C are aligned in parallel to each other, so that the hairs of adjacent hair extensions C do not get knotted to each other.

Also on the second tape 4 there are applied hair extensions C of a respective second plurality B, with modes substantially identical to those described with reference to the first tape 2 and to the first plurality A.

The assembly 1 comprises also support tapes (not shown), made of a material easily detachable from the adhesive tapes 2, like, for example, silicone-coated, linenized paper or plastic, arranged to protect the adhesive faces 43, 44 and the connecting elements 9, so as to prevent the adhesive tapes from folding, curling and sticking.

The adhesive material used on said adhesive faces 43, 44 has an adhesive force on the tape 2 greater than that produced on the material of the connecting element 9, so that, on the latter, no adhesive material residues remain at the end of the application.

Lastly, the tape 2 or the tape 4 can contain an indication of information relevant to the hair extensions C. Such information may be related to: the density of the hair extensions, their dimensions, their number, the spacing, the dimensions of the connecting elements.

This indication may be expressed in any one form: by a writing, a color, a code, a drawing optionally to be interpreted on the basis of a suitable table.

The tapes 2, 4 have positioning elements that, in the present embodiment, are holes 6 located at the corners of the tapes 2, 4. It is proposed that the position of the holes 6 on the first and second tape 2, 4 is complementary, i.e., by overlapping said tapes 2, 4 the perfect overlapping of the holes 6 is attained.

The positioning of said holes is such that the connecting elements 9 of the extensions of said first and second plurality A, B overlap when the holes 6 are in turn overlapped.

To connect the connecting element 9 to the respective end, various systems can be used, among which hot gluing, injection, etc.

The preferred form of the connecting element is that of a rectangle, with width and thickness (magnified in the drawings) substantially equal to those of the respective hair extension C to limit to the minimum the quantity of thermoplastic material that, as described below, operates as the adhesive.

Therefore, it is proposed that said connecting element 9 could have different sizes, usually discernible among large, for thick hair extensions of elevated length and thickness; medium, for hair extensions of intermediate length and thickness; and small, for hair extensions characterized by their minimal thickness, suitable for applications thick with hair extensions. This information will be referred to the indicator associated to the containment element 50 mentioned above.

Again with reference to the present embodiment, the thermoplastic material is a substance suitable for being melted at a temperature higher than the room temperature, assuming the properties of a plastic fluid, and then cooling and solidifying at room temperature.

Substances with similar properties can be melted using the direct application of mechanical energy, in the form of high frequency vibrations, in particular, ultrasonic vibrations. In this case, the intermolecular vibrations and the resulting friction generate the quantity of heat necessary to plastically move the molecules with respect to each other. The generation of heat stops when the vibrations cease, resulting in an almost immediate solidification.

Examples of substances that can be used as a thermoplastic material are polyesters, polyamides, polyurethanes, etc.

The function of the connecting element according to the present invention is that of holding together the hairs of each hair extension C and that of providing the attachment point of the hair extension to the hair of the hair being thickened.

The connecting element 9, which can have a color compatible with that of the hair of the hair extensions 6, can also be embellished with additional decorative elements such as artificial gems, etc.

The face of the connecting element 9 opposite to that placed on the respective adhesive face 43, 44 has longitudinal ribs 3, whose edges are parallel to the hair of the hair extensions C. Each rib has a substantially V-shaped section.

The formation of the ribs 3 is disclosed with reference to FIGS. 16 to 19. It is illustrated a device for laying the connecting elements 9 of hair extensions C that, by way of example, are represented by different colors for the same adhesive tape, a solution hinting at the freedom that can be enjoyed in the implementation of the method of the present invention.

Figure 18:
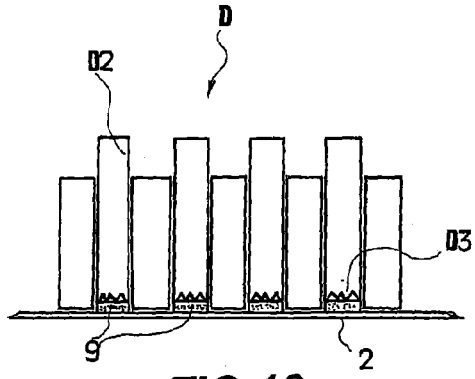
Figure 19:
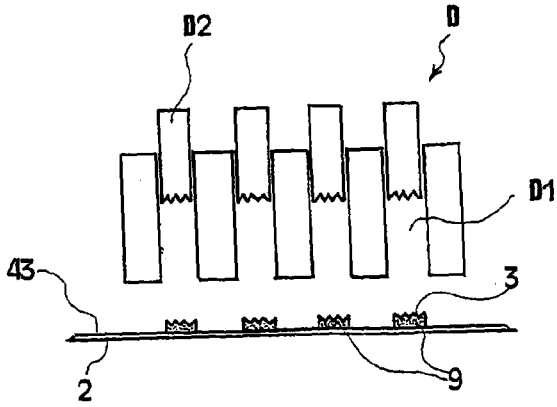

The placing device, indicated by D, is located on the adhesive face 43 of an adhesive tape 2 and has placing ducts D1 containing one connecting element 9 each. In each laying duct D1 there may slide a plunger D2 having a bottom end D3 intended to press on said connecting elements to place them onto the adhesive face and adhere them to the glue (FIG. 18).

Each bottom end D3 has ribs D4 with linear edges to imprint, on each connecting element 3, the ribs 3 described above.

For an improved forming of the ribs 3 on the connecting element 9, the ribs of the plunger D2 may be gently heated.

Figure 1:
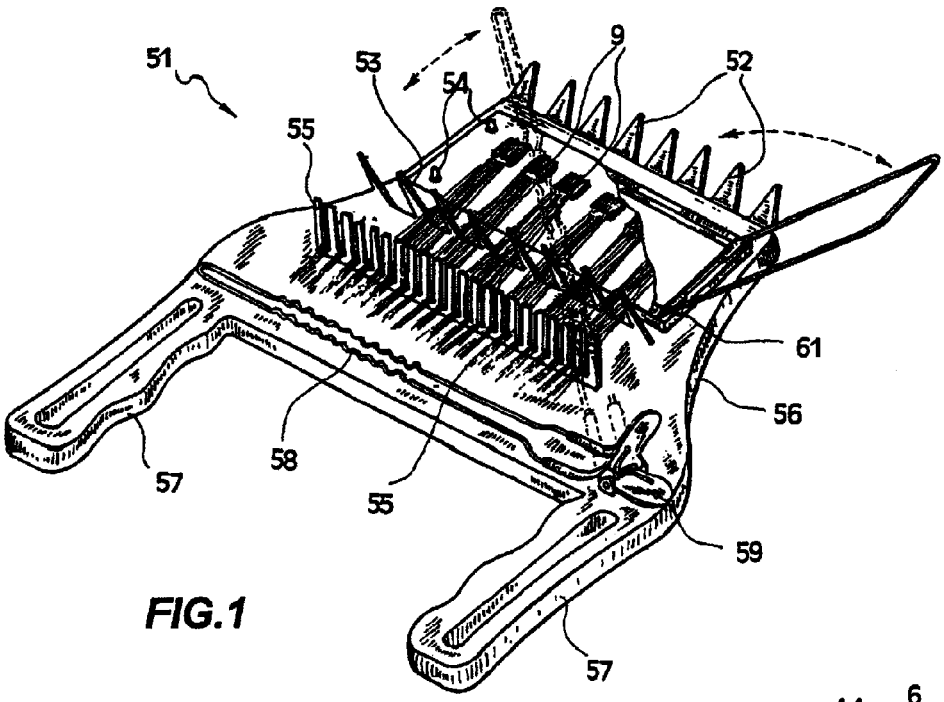
FIG. 1 shows a perspective view of a separator device for receiving hair according to the invention.

The assembly 1 is applied with a separator device 51 (FIGS. 1 and 4) which is capable of subdividing a portion T of hair apt to receive said hair extensions in adjacent portions 60 of receiving hair basically consisting of the same quantity of receiving hair, said portions 60 being already spaced with regard to the position of the connecting elements 9 that will be applied as it will be described below.

For this purpose, the device 51 comprises a plurality of first tooth elements 52, basically triangle-shaped. They, for dimensions and spacing, could automatically select said adjacent portions 60, merely by placing said portion of hair thereon, taking care to arrange said portion T with a uniform thickness of receiving hair.

Advantageously, the present embodiment implies that the separator device 51 comprises a bearing surface 53, suitable for the placing of the first tape 2 receiving the connecting elements 9. There could be indexes or margins, not depicted in detail, for correctly positioning the tape 2 with respect to the tooth elements 52 and therefore to the portions 60 of receiving hair.

Anyhow, the bearing surface 53 will have a width equal to that of the tape 2, to facilitate its positioning. Sideways, the surface 53 comprises indent-shaped stops 54, apt to be inserted in the holes 6 described above, for an even more correct positioning of the tape 2. Note how the first tooth elements 52 substantially delimit the bearing surface 53, being arranged on opposite sides of the surface 53, crossed by the portions of receiving hair 60.

The position of the stops 54 is such that, once provided accurate measures for the assembly 1, the connecting elements 9 will be positioned at the notches between each first tooth element 52, so that the separated receiving hair T fall exactly on the respective connecting element 9.

The device 51 further comprises second tooth elements 55, arranged at the opposite side with respect to said first tooth elements, having with respect to the latter a higher density and interspaces such as to arrest the receiving hair T inserted therebetween.

In practice, the second tooth elements 55 are arranged comb-like so as to act as clasp for the separated receiving hair T.

Note that, with the tape 2 set in its position, the connecting elements are spaced by the first tooth elements 52 separating the receiving hair. Thus, it is prevented that hair intended for a connecting element be badly arranged diagonally or curling and fall on the wrong connecting element.

This advantage is attained in combination with the second tooth elements 55 that help to keep tensioned the receiving hair, straightening any curling.

The bearing surface 53 is formed on a support 56. Therefore, the device 51 comprises at least one handle connected to said support 56. In the present embodiment, the device 51 comprises a pair of opposing handles 57, arranged sideways at the side opposite to that onto which the receiving hair is arranged.

Thus, the operator, indifferently right- or left-handed, could support the device with the right hand to arrange the hair on the device, to then grab it with the left hand and use the right one to close the tape 2, or vice versa.

Lastly, in a position corresponding to the second tooth elements 55, the device 51 comprises means for securing the receiving hair and the hair extensions 6 in a preset position. Such means, in the present embodiment, comprises a spring clasp 58 that rotates sideways to the hair and can be driven by virtue of a button 59.

A further means operating to keep the tape 2 in position is the electrostatic attraction generated between tape and bearing surface 53, assuming that they be made from materials apt to bring about this effect.

Figure 4:
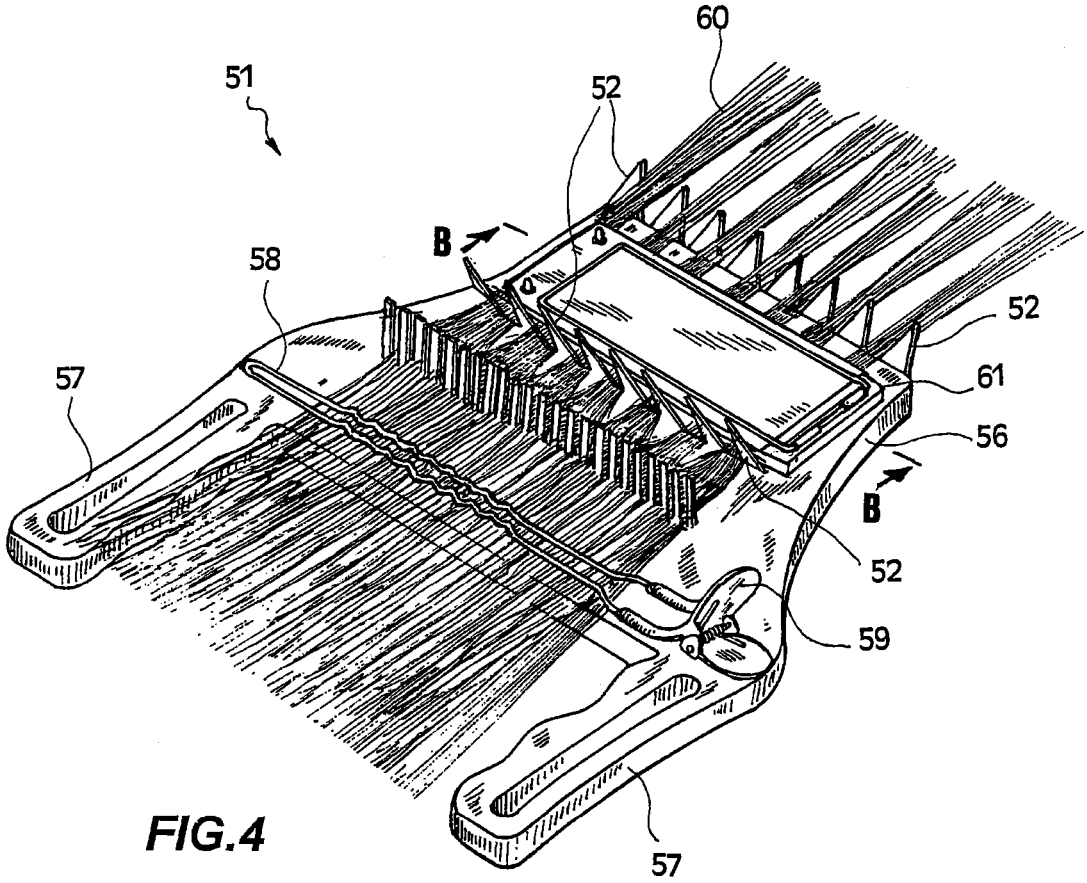
FIG. 4 illustrates the use of the device and of the assembly of the preceding figures in the method according to the invention.
Figure 5:
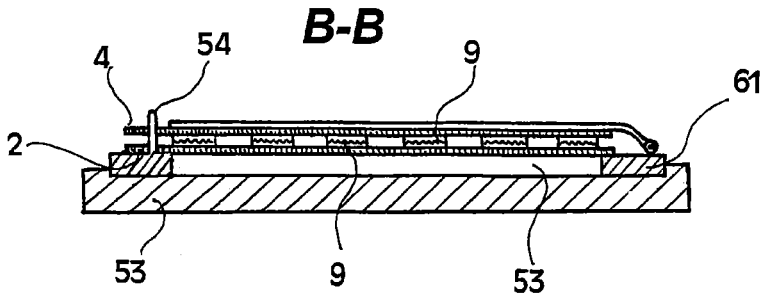
FIG. 5 shows a section, taken along line B-B in FIG. 4, of a detail of the device and of the assembly of the preceding figures.
Figure 6:
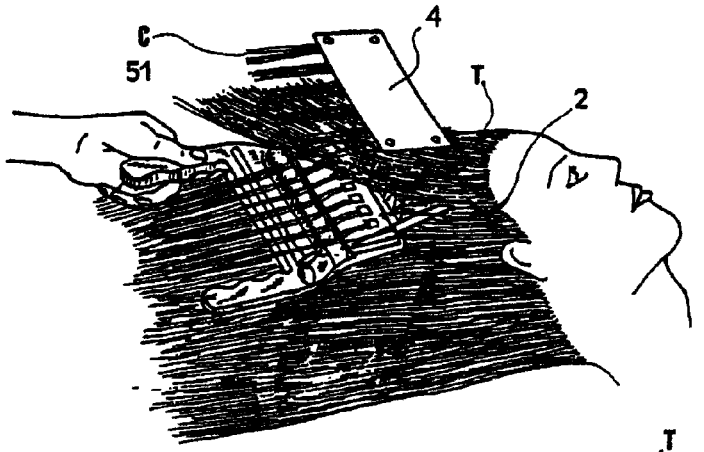
FIGS. 6 to 12 schematically illustrate, using perspective views, various steps of the thickening method according to the present invention, carried out with an assembly and a separator device according to the invention.
Figure 7:
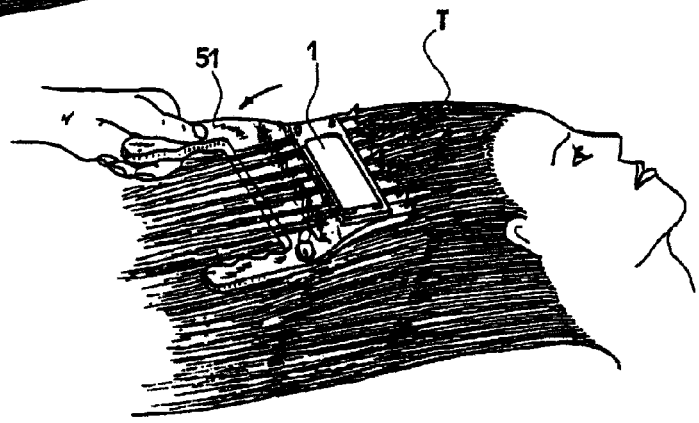
Figure 8:
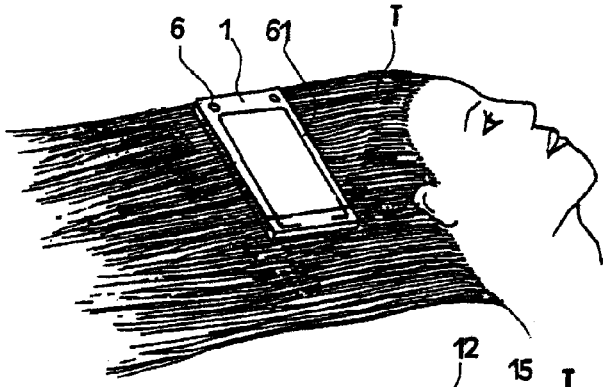
Figure 9:
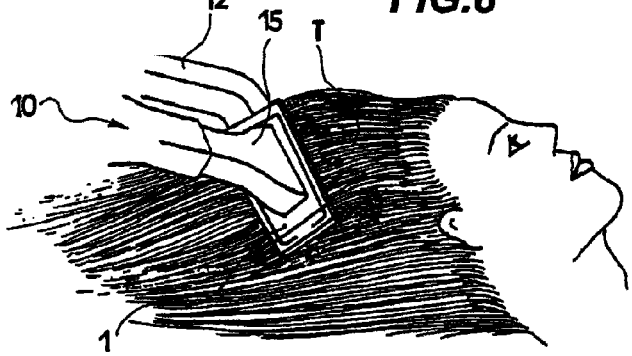
Figure 10:
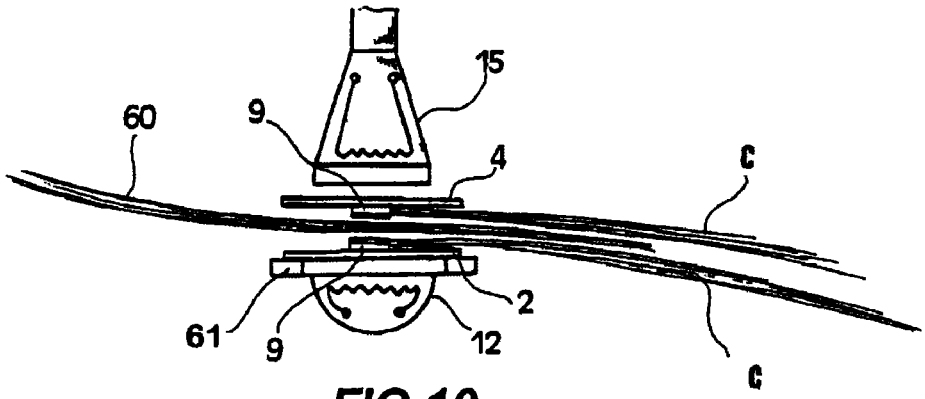
Figure 11:
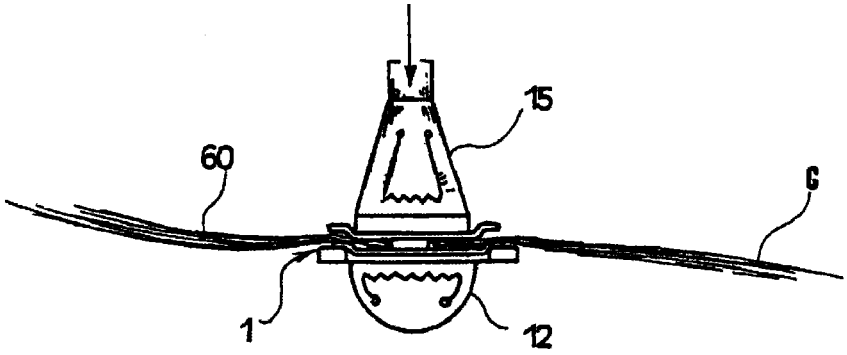

Once arranged, with modes that will be described below, the first tape 2 with the connecting elements 9 and the portions of receiving hair 60 duly separated, onto the separator device 51 there could be arranged also said second tape 4 with the second plurality B of hair extensions C. For the positioning of the second tape 4, there could be employed the stops 54 so that the holes 6 of the first and second tape 2, 4 overlap, thereby overlapping the respective connecting elements to the corresponding portions of receiving hair 60 located in the middle (FIG. 4).

To hold the tapes 3, 4 and the receiving hair 60, the device is provided with a gripper 61 operating, with a spring-actuated gripping, onto the tapes 2 and 4, so as to leave their faces free. Such a gripper can be movable and the separator device 51 could be removed, once the assembling of the assembly 1 has ended, leaving the gripper 61 in operation.

With reference to the thickening assembly 1 described above, a method for thickening hair comprises the subsequent application steps, described with reference to FIGS. 6 to 12.

The method proposes a step wherein a portion P of the hair T to be thickened is prepared by a combing, to align all hair in parallel to each other.

The separator device 51 is in turn prepared with a first adhesive tape 2 of the assembly 1 with the hair extensions C combed and aligned to each other.

In the subsequent step, said separator device 51 is arranged at a portion of hair T to be thickened, so that said portion may be separated in adjacent portions 60 (FIG. 3), containing basically the same quantity of receiving hair, each portion 60 being corresponding to a connecting element 9 placed on said first adhesive tape 2 and equidistant from the other portions.

In this step it is made use of the separator device 51 for correctly resting the tape 2 before adhering it onto the portion of the receiving hair T. a portion of hair T is combed, tensioned, arranged on a plane of width equal to that of the portion of tape 2 receiving the hair extensions C and laid on the first and on the second tooth elements 52, 55, determining the perfect separation of the receiving hair in equal, equidistant, tensioned portions, in a position coincident to that of the receiving connecting element 9.

Subsequently, said method comprises an additional step wherein a portion of hair T to be thickened is enclosed between said first tape 2 and the second tape 4.

The second tape 4 is rested to the separator device 51 at its bearing plane 53, with its adhesive face 44 facing the head and the external non-adhesive face.

Thus, the assembly 1 is closed with an overlapped configuration, as described with reference to the separator device 51. This step can be carried out supporting the device with either one hand at will or leaving the device suspended by virtue of the spring clasp 58. Once arranged the assembly 1 onto the hair T, the separator device 51 can be removed.

In this step, the gripper 61 can be left in operation, to further ensure the holding of the assembly 1 on the hair.

Subsequently it is made use of an applicator 10 for activating the connection means, i.e., for heating and/or transmitting mechanical energy via ultrasonic frequency vibrations to the connecting elements 9.

This is implemented by compressing the tape 2 folded between a fixed element 12 of the applicator 10 and a respective movable element 15. In this phase, connection means essentially consisting of the connecting elements 9 are activated by the operator. The fixed element 12 and the pressure element 15 can act through the space left free by the closed elements of the gripper 61.

In the present embodiment, the melting property of the thermoplastic material is used. In fact, it is proposed that energy be applied to the connecting elements 9 via the adhesive tape 1. Therefore, the gripper applicator 10 is used in which the fixed element 12 and the movable element 15 have an elongated shape and can compress, applying a substantially uniform pressure, the entire assembly 1 along its length, thereby compressing the connecting elements 9. The latter could even be merely pressure-activated. The ribs 3 help to entrap and hold still the receiving hair 60 of the hair portion T.

In this context, an alternative system for transmitting energy to the connecting element 9 can be used as well.

This system proposes the use of mechanical energy in the form of ultrasonic frequency vibrations, for example in the range from 20 to 60 kHz. In this case, one or both of the pressure elements will be connected to a vibrating body, for example a piezo-electric element subjected to alternating current at the desired frequency and they will transmit these vibrations to the connecting element 9, both directly and through the tape 1.

In this case, note that the application of vibrations allows the molecules of the connecting element 9 thermoplastic material to flow easily between the individual hairs of the hair extension 6 and the hair T, penetrating and joining them together.

The applicator 10 is actuated, and a constant pressure, not subordinate to the thickness of what is comprised between the elements 12, 15 operating like a gripper, is exerted for a time interval of predetermined length, uniformly along the remainder 4, or equally on each connecting element 9 that is transformed in a connection on the hair.

It is proposed that this application, according to the same modes, could be repeated an infinite number of times always with identical results and without requiring the operator to exert any muscle force.

Conveniently, it is possible to apply plural adhesive tapes 2, to then activate said connection means in a rapid sequence.

It is proposed that operation parameters like: exerted pressure, pressure duration, heating (temperature), heating duration, vibration frequency, vibration intensity, duration of vibrations, could be preset and stored in the control unit, and could be varied according to the specifications of the hair extensions and of the connecting elements to be applied.

Once this connection step is complete, it suffices, at the end of the cooling, to remove adhesive tapes 2, 4 without leaving any glue on the hairs, to complete the application.

Figure 12:
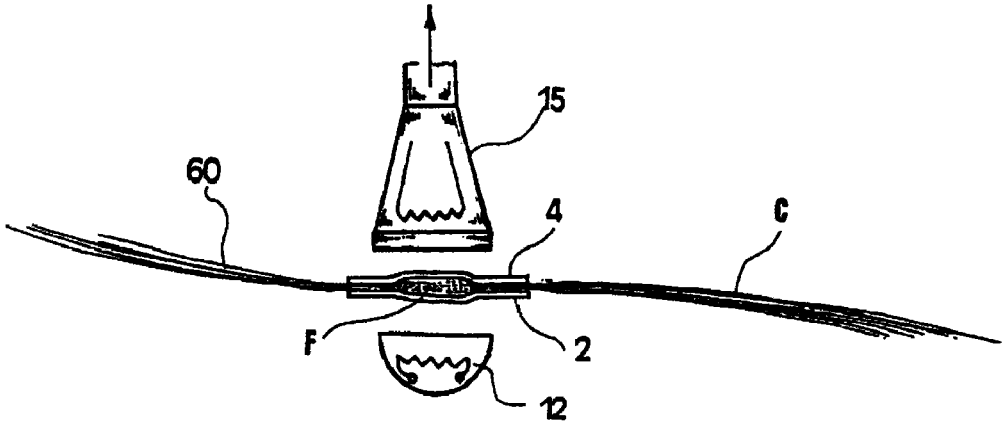

In the present embodiment, the applicator 10 is actuated for the compression-heating cycle. The combined heat and pressure, crossing the tapes 2, 4, melts the thermoplastic material that penetrates between the hairs of the hair T and of the hair extension C (FIG. 12). Note that both the fixed element 12 and the movable element 15 are internally heated.

Thus, the thermoplastic material tends to migrate through the hair T and anyhow its position is confined on both sides by the tapes 2, 4. The migration takes place on both sides and optimally entraps the receiving hair 60. This process prevents the thermoplastic material from being compressed on the face of one of the tapes, and it is prevented the formation of plane and shiny faces of solidified thermoplastic material, faces that otherwise would be visible.

Once the pressure and the heating are discontinued, the thermoplastic material solidifies remaining confined between the tape 2. After a reasonable cooling, the tape 2 can be removed, but it is also possible to remove all tapes once the application of plural assembly 1 has taken place.

However, it is proposed that the dimensions of the connecting element and of the thermoplastic material portion may be reduced at will, without substantially influencing the capacity of the hair extensions C to be connected to the respective hair.

From the description, it is proposed that this method of hair extension does not require any manipulation on the part of the operator and enables the formation of hair extension-hair connections with very small dimensions, considering that the pressure elements, with the presence of two tapes, contain the material that enables the connection to occur. The resulting connections are very subtle, with finished edges, void of shiny faces, substantially imperceptible. The only manual intervention is based on manipulating the device that is used to activate the connection.

The dimensions of the connection are not subordinate to the fact that the thermoplastic material and the hair of the hair extension must forcibly surround the hair of the hair, creating a connection point whose volume cannot be reduced below a certain limit. For example, in the above cited Japanese Patent, the simple fact that the hair of the hair extension must be wound around the hair of the hair creates in itself a voluminous connection.

According to the present invention, the dimensions of the connection point depend exclusively on the quantity of hair compressed within the hair extension: the more subtle the hair extension, the more subtle the connection.

For this purpose, the use of the separator device 51 allows to uniformly distribute the receiving hair between the connecting elements. This is particularly advantageous when the receiving hair are scanty and/or curled: such a situation could produce more evident differences, and in that case a connecting element could be found compressed and melt in scanty hair, with the risk that the thermoplastic material be squeezed sideways, attaching to the adjacent connecting element. Instead, thus this risk is substantially eliminated.

The lack of manipulation therefore leads to the formation of uniform connections. Their optimal quality prevents disconnection due to, for example, penetration of water and the like.

With this system, it is also possible to hide the hair extensions within the hair. Then, because it is possible to apply hair extensions equidistant to each other, additional extensions can be applied between them, with the possibility of obtaining consistent extensions within brief periods and to create complex streaks (highlights) by mixing in extensions with colors different to the hair of the user.

The method reduces the quantity of thermoplastic material used, energy used for activation, with no loss of heat and no contamination of the instrument or the connection device.

In addition, as can be appreciated, the thickening method described above and the related assembly of hair extensions, due to the possibility of using numerous application variations, allows the professional operator to make maximum use of their imagination.

With particular reference to the use of the two tapes, the following advantageous operative results are attained: (a) Once separated, the hairs of the user are held in a fixed position by the tapes 2 and 4 and thus it is easier to manipulate the applicator 10 avoiding to cross hairs and hair extensions to each other. (b) The hairs of the user are protected from heat by being enclosed in said folded shape. (c) The thermoplastic material is enclosed between two tapes or films and therefore cannot escape confinement, better entrapping the receiving hair without involving other hairs. (d) The surface of the fused and solidified connecting element is substantially not perceptible to the feel. The quality of this connection prevents water from penetrating between hairs of the connection, which is substantially sealed by the thermoplastic material. (e) The tape, which prevents outlets of thermoplastic material, prevents gripper contamination. (f) The tape can be held adhered until the end of the cooling of the thermoplastic material, without in the meantime preventing further connections, saving time. (g) The tape holds fixed the combing, which thus is more precise.

The aforedescribed method is not limited to a number of hair extensions adhered to the respective tape, number that can vary from one on.

Figure 22:
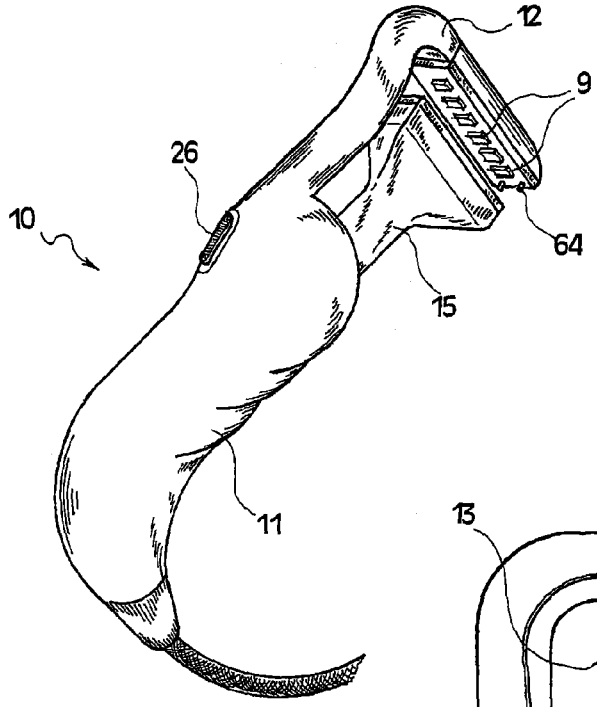
FIG. 22 shows a perspective view of a third embodiment of an applicator according to the invention.

With general reference to FIG. 22, an exemplary applicator for hair extensions is generally indicated by 10. It has a body 11 operating as handle and housing internal devices that will be described below. To the body 11, a fixed contrasting element 12 is secured, comprising a bearing plane 13 such as to bear connecting elements 9 of hair extensions on a support tape 2 as described above, and the corresponding hair of a hair T to be thickened.

The applicator 10 further comprises a movable pressure element 15 acting on said fixed element 12. It has a pressing plane 16 formed on the extremity of a rod 17 extending from the body 11, the axis of the rod 17 being coincident to the axis of development of the body 11. Also the pressing plane 16 is substantially perpendicular to the development of the body 11.

The movable pressure element 15 is driven by a pneumatic device 18 (not shown) operating at a predetermined pressure, housed in the body 11.

The movable pressure element 15, at its pressing plane 16, is heated to activate the adhesion of the connecting elements 9. For this purpose, in the movable pressure element 15 there is housed a power fed thermistor 24. Likewise, also the fixed element 12 comprises a thermistor 25.

The compression-heating cycle is initiated in response to the actuation of a button 26 on the body 11.

Figure 13:
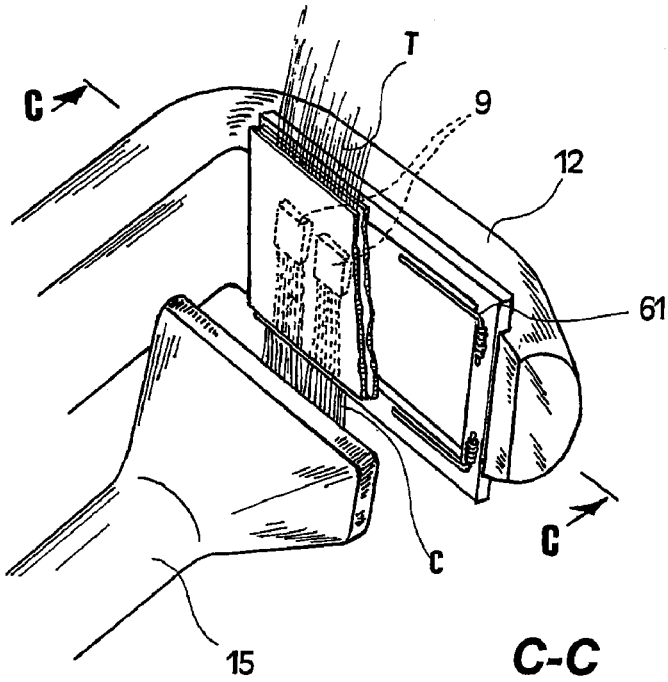
FIG. 13 shows a partially sectional perspective view of a portion of a first embodiment of an applicator according to the invention.
Figure 14:
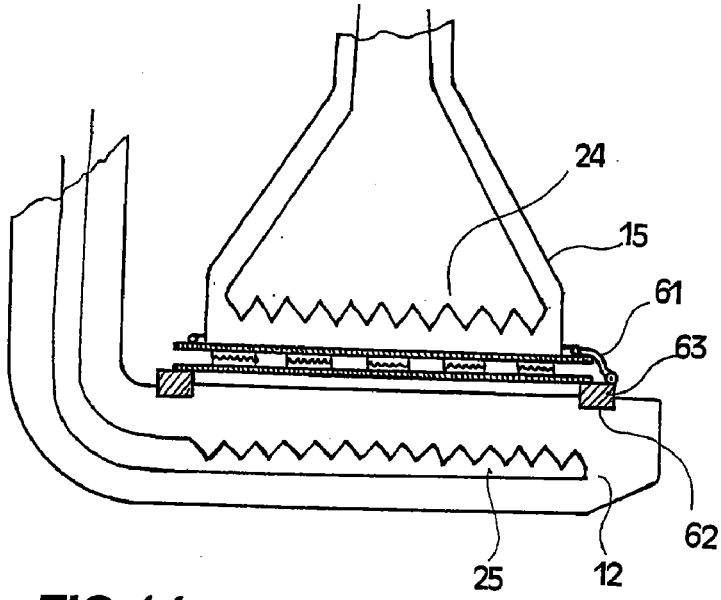
FIG. 14 shows a section, taken along line C-C, of the applicator of FIG. 13.

With reference to FIGS. 13 and 14, it is disclosed a first embodiment of the applicator 10 that has been described above only in its general features. According to this first embodiment, the fixed element 12 comprises means for positioning the tapes, the connecting elements and the portions of hair, in a predetermined position on said fixed element and pressure element. Such means comprises the gripper 61 described above with reference to the separator device 51. For this purpose, the fixed element 12 has recesses 62 for receiving the edges 63 of the gripper 61, mounted beforehand on that separator device 51.

Figure 20:
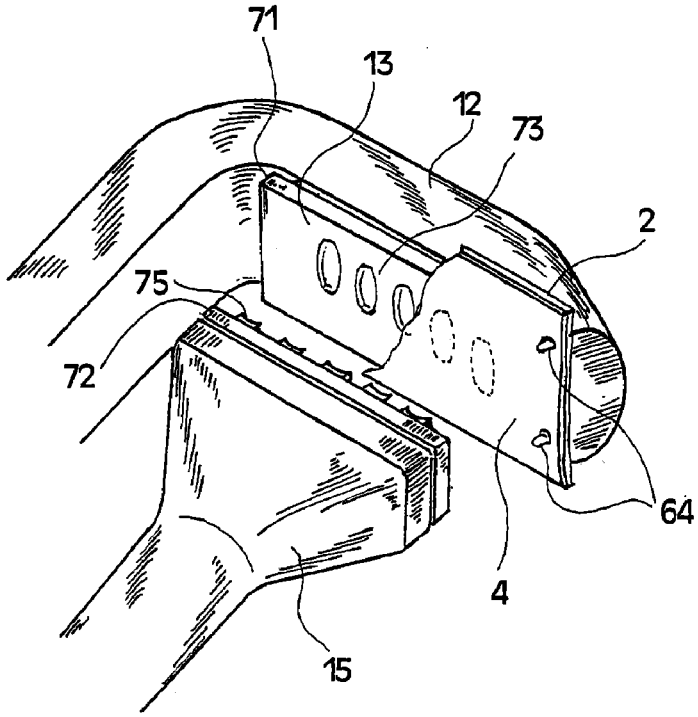
FIG. 20 shows a partially sectional perspective view of a portion of a second embodiment of an applicator according to the invention.
Figure 21:
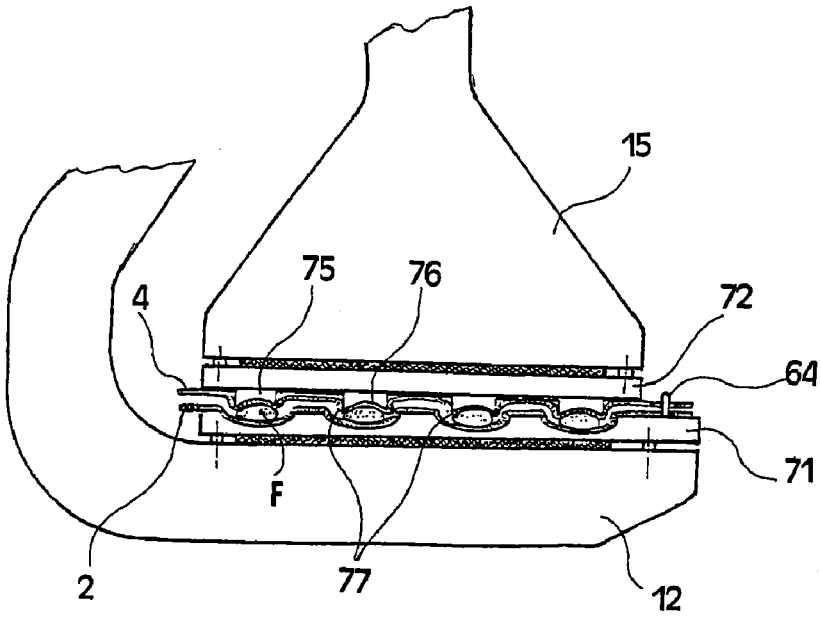
FIG. 21 shows a section of the applicator of FIG. 20.

With reference to FIGS. 20 and 21, it is disclosed a second embodiment of the applicator 10, wherein the means for positioning the tapes, the connecting elements and the portions of hair, in a predetermined position on said fixed element and pressure element, comprise indent-shaped stops 64 similar to those described above with reference to the separator device 51.

In this embodiment, the bearing planes 13 and 16 of the fixed element 12 and of the movable element 15 are formed on removable plates, indicated by 71, 72, respectively. Both plates can be positioned by exploiting the stops 64 mentioned above. The first removable plate 71, mounted onto the fixed element 12, has a plurality of recesses 73 that, in a plan, are basically oval or elliptical. They are preset to receive the connecting elements 9 placed on the first adhesive tape 2 described above. The correct positioning is obtained by virtue of said stops 64.

Figure 15:
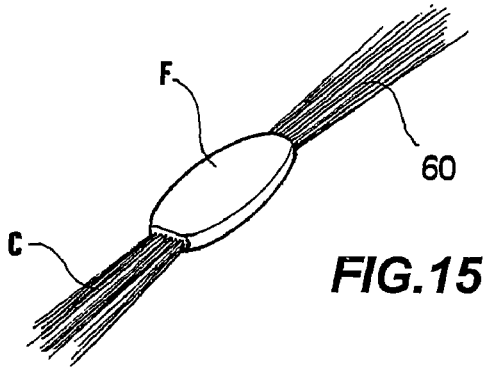
FIG. 15 shows a perspective view of a connection between hair extensions and receiving hair.
Figure 16:
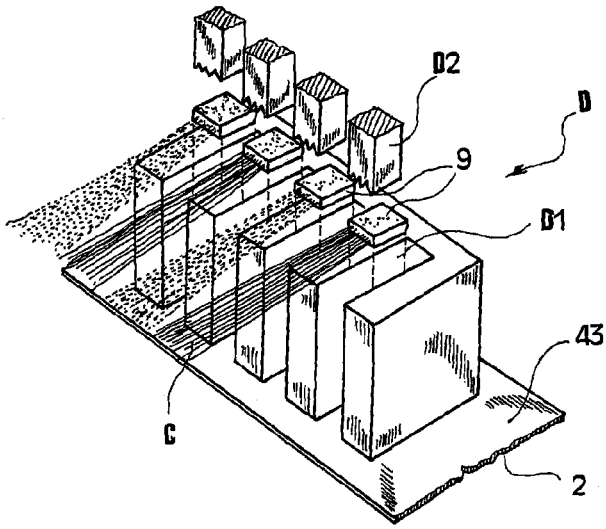
FIGS. 16 to 19 illustrate the steps of deposition of connecting elements and respective hair extensions on an adhesive tape, with the forming of the connecting element.
Figure 17:
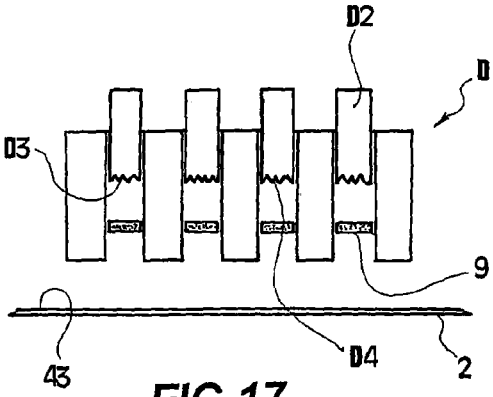

The second removable plate 72, mounted on the movable element 15, has a plurality of punches 75, each corresponding to said recesses 73. The punch 75 has a configuration such as to fit the respective recess 73; onto its top, the punch has a recess 76 of oval or elliptical shape and with substantially cutting edges 77. Thus, the sideways migration of the thermoplastic material of the connecting element is arrested: the thermoplastic material engages all the space comprised between recess 73 and recess 76, blocking all hair therein. The form of the resulting connection, indicated by F, is depicted in FIG. 15.

Below each removable plate 71, 72 there are printed, with silk-screen techniques, the thermistors 24, 25 that are electrically connected to generate heat. For this purpose, the plates 71, 72 are thin and of metallic material, with a high thermal conductivity. By virtue of this, considering the low thermal capacity of the silk-screen printed thermistors and of the removable plates, heat generation is such that at the thermoplastic material the melting temperature is reached immediately and the cooling occurs instantly, once current flow has ended.

Figure 23:
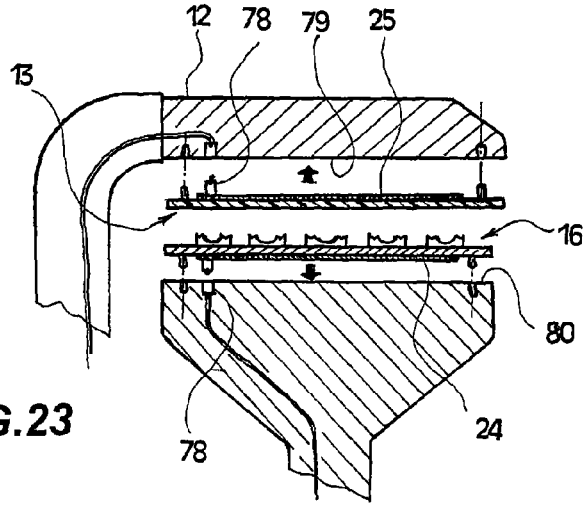
FIG. 23 shows a partially exploded section of the applicator of FIG. 22.
Figure 25:
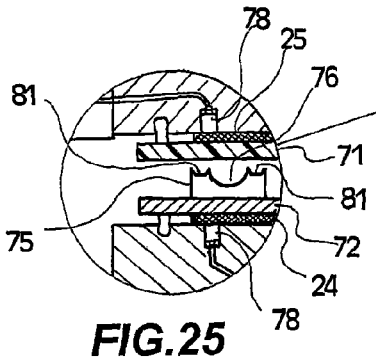
FIG. 25 shows a detail of the section of FIG. 24.
Figure 24:
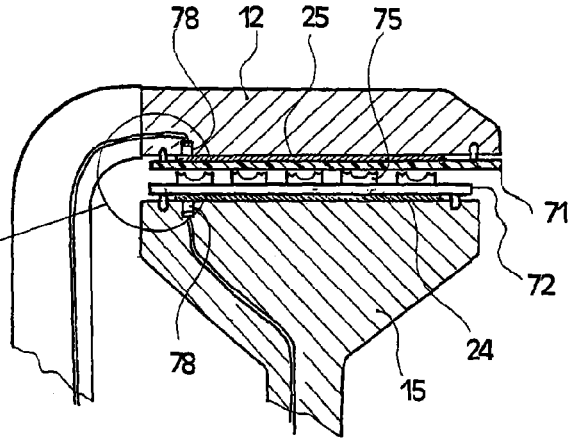
FIG. 24 shows the section of FIG. 23 in assembling.

With reference to FIGS. 23 to 25, it is disclosed a third embodiment of the applicator 10, attaining the advantages of the preceding embodiment. In this embodiment, the means for positioning the tapes, the connecting elements and the portions of hair, in a predetermined position on said fixed element and pressure element, comprises indent-shaped stops 64 analogous to those described above with reference to the separator device 51, but here depicted in FIG. 22.

The thermistors 24, 25 are printed, rather than on the fixed and movable elements 12, 15, on the back of the plates 71, 72 that are provided with electrical contacts 78. The plates 71, 72 rest on respective insulated planes 79, 80.

The bearing plane 13 on the fixed element 12 is of a soft, pliable material. For this purpose, the first plate 71 can be implemented with a thin layer of rubber. Instead, the second plate 72 has punches 75 having each a central recess 76 contoured to a twin cutting edge 81 cooperating with the pliable surface of the first bearing plane 13 for isolating the thermoplastic material inside the recess 76. Anyhow, thus the form of the connection F is perfectly defined.

To the aforedescribed method for thickening hair, separator device, assembly and applicator one skilled in the art, in order to satisfy further and contingent needs, may effect several further modifications and variants, all comprised within the protective scope of the present invention, as defined by the appended claims.

What is claimed is:

1. An assembly for thickening hair, comprising:

a first adhesive tape, apt to be reversibly adhered on hair, having an adhesive face onto which there are arranged connecting elements of hair extensions of a first plurality of the hair extensions at their respective distal end; and a second adhesive tape, apt to be reversibly adhered on hair, having an adhesive face onto which there are arranged connecting elements of hair extensions of a second plurality of the hair extensions at their respective distal end, the first and second adhesive tapes having positioning elements such that the connecting elements of the hair extensions of said first and second plurality of the hair extensions overlap when the positioning elements are in turn overlapped.

2. The assembly according to claim 1, wherein said first and second adhesive tapes consist of distinct adhesive tape sections.

3. The assembly according to claim 2, wherein said positioning elements are holes arranged at the corners of the first and second adhesive tapes.

4. The assembly according to claim 1, wherein said first and second adhesive tapes are substantially transparent.

5. The assembly according to claim 1, wherein said adhesive faces have an adhesive of a non-permanent and reversible type, operated by pressure.

6. The assembly according to claim 5, wherein the adhesive of said adhesive faces has an adhesive force on a corresponding one of the first and second adhesive tapes greater than that produced on the connecting element on the corresponding one of the first and second adhesive tapes.

7. The assembly according to claim 1, wherein the connecting elements on the first and second adhesive tapes are made of a thermoplastic material.

8. The assembly according to claim 1, wherein the connecting elements are substantially equidistant and placed at the center of a corresponding one of the first and second adhesive tapes, the hair extensions being aligned in parallel to each other, so that the hairs of adjacent hair extensions do not get knotted to each other.

9. The assembly according to claim 8, wherein a first face of the connecting element opposite a second face of the connecting element on the adhesive face of the corresponding one of the first and second adhesive tapes has longitudinal ribs, whose edges are parallel to the hair of the of the hair extensions.

10. The assembly according to claim 9, wherein each rib has a substantially V-shaped section.

* * * * *